US005915543A

United States Patent [19]

Julin

[11] Patent Number: 5,915,543

[45] Date of Patent: Jun. 29, 1999

[54] BACK PROTECTOR FOR MOTORCYCLIST

[75] Inventor: Jasmine Julin, Helsinki, Finland

[73] Assignee: L-Fashion Group OY, Lahti, Finland

[21] Appl. No.: 08/853,353

[22] Filed: May 8, 1997

[30] Foreign Application Priority Data

May 9, 1996 [FI] Finland ..... 961979

[51] Int. Cl.[6] ..... A41D 13/00

[52] U.S. Cl. ..... 2/467; 2/44; 2/455

[58] Field of Search ..... 2/44, 455, 456, 2/463, 465, 467; 128/846; 602/19

[56] References Cited

U.S. PATENT DOCUMENTS

| | | | |
|---|---|---|---|
| 245,655 | 8/1881 | Phelps | 2/44 |
| 508,713 | 11/1893 | Horn | 2/44 |
| 911,324 | 2/1909 | Orear | 2/44 |
| 930,283 | 8/1909 | Hart | 2/44 |
| 2,906,260 | 9/1959 | Myers | 602/19 |
| 2,973,030 | 2/1961 | Matthewson | 2/44 |
| 4,397,046 | 8/1983 | Steiner | 2/44 |
| 4,453,271 | 6/1984 | Donzis | 2/463 |
| 4,610,035 | 9/1986 | Mattila | 2/2 |
| 4,680,812 | 7/1987 | Weigl | 2/2 |
| 5,095,549 | 3/1992 | Aldridge | 2/304 |
| 5,140,995 | 8/1992 | Uhl | 128/846 |
| 5,471,680 | 12/1995 | Vesterinen | 2/44 |

FOREIGN PATENT DOCUMENTS

| | | |
|---|---|---|
| 44 15 876 | 11/1995 | Germany . |
| 20748 | 11/1910 | Norway . |
| 1 049 301 | 11/1966 | United Kingdom . |
| 2 249 942 | 5/1992 | United Kingdom . |

*Primary Examiner*—John J. Calvert
*Assistant Examiner*—Gary Welch
*Attorney, Agent, or Firm*—Arnold, White & Durkee

[57] ABSTRACT

The invention relates to a back protector (1) for a motorcyclist, the object of which is to take up the impacts the motorcyclist's back side is exposed to in case of an accident and to protect against abrasions caused by the ground surface. The back protector (1) according to the invention comprises a protective part (3), shoulder straps (4) and fastening means (5) for fastening the back protector (1) to driving trousers (2). The first ends of the shoulder straps (4) are fastened to the upper end of the protective part (3). The second ends of the shoulder straps (4) are fastened to the front side waistband of the driving trousers (2) by the fastening means (5). On the other hand, the lower end of the protective part (3) is fastened to the back side waistband of the driving trousers (2) by the fastening means (5). The back protector (1) according to the invention is easy to put on, comfortable to wear and it serves both as a protector against falling and as a brace.

5 Claims, 1 Drawing Sheet

BACK PROTECTOR FOR MOTORCYCLIST

Figure 1:
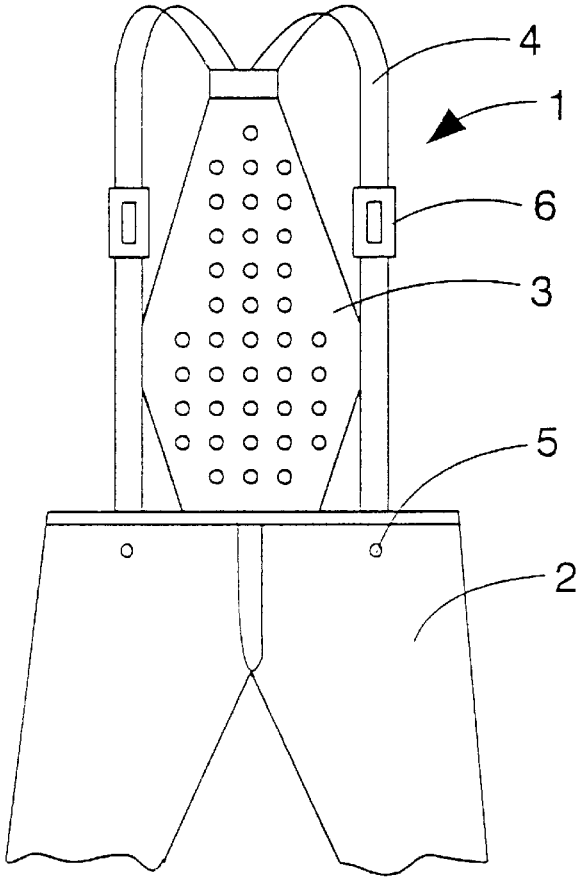

The invention relates to a back protector for a motorcyclist, the protector comprising a protective part absorbing impact energy and means for fastening the protective part against the motorcyclist's back.

To protect motorcyclists (also called motorists here) in case of accidents, various protectors have been developed, which take up part of the impact energy at a fall and protect against abrasions and bruises caused by the ground surface. Traditionally, driving garments for motorists are provided with pads. Pads have been used especially in driving garments of leather. However, leather garments are sweltering, heavy and uncomfortable to wear and no sufficient protective effect can be provided by means of pads. Therefore, combinations of jacket and trousers made of modern breathing fabric materials have gained ground, separate additional protectors being used at the most critical points. One such separate protector is also the back protector for a motorist and, in view of driving comfort, it is not sensible to form this back protector as a stationary padding in the driving garment. It is known to provide driving garments made of fabric material with detachable protectors to be pushed into pockets inside the driving garments. However, when a big back protector is positioned into such a pocket formed on the back side of a driving jacket made of a light fabric material, the driving jacket becomes uncomfortable to wear, because the back protector makes the back side of the jacket heavier than the front side, due to which the jacket tends to move downwards on the back side and towards the motorist's neck on the front side, respectively. The jacket collar then presses the motorist's neck in an unpleasant way and restricts his movements.

Known are also detachable back protectors for motorcyclists, comprising separate fastening means and being put on separately under the driving jacket. In these back protectors are used various straps, belts or similar fastening means for tying the back protector in place on the motorist's back. To hold the back protector in place, it has to be pulled by means of its fastening means tight to the motorist around the motorist's mid body. The fastening means then extend around the motorist's belly side.

A drawback of such back protectors is, however, that the fastening means of the back protectors restrict the motorist's movements and provide an unpleasant pressing feeling. In addition, the back protector tends to move during driving in spite of tight fastening on account of the motorist's movements during driving. The back protector usually moves upwards on the motorist's back, toward his neck, presses him on the neck and causes an unpleasant feeling. Further, said back protector is difficult to put on, due to which the protector easily remains unused or it is put on wrong. The protective effect of a protector put on wrong is in case of an accident essentially less than planned, because put on wrong the protector does not stay in place at a fall. Moreover, generally used back protectors are made of dense unbreathing material, for which reason they are sweltering and heavy.

The object of this invention is to provide such a back protector for a motorcyclist which is easy to put on, comfortable to use and unsweltering and protects the motorist as well as possible in case of an accident.

The back protector for a motorcyclist according to the invention is characterized in that the back protector comprises shoulder straps with their first ends fastened to the upper end of the protective part, that the second ends of the shoulder straps can be fastened to the front side waistband of driving trousers and that the lower end of the protective part can be fastened to the back side waistband of the driving trousers, due to which the back protector fastened to the driving trousers serves both as a protector against falling and as braces.

The essential idea of the invention is that the back protector comprises shoulder straps with their first ends fastened to the upper end of the protective part and with their second ends to be fastened firmly to the front side waistband of the driving trousers, and that the lower end of the protective part of the back protector is fastened to the back side waistband of the driving trousers, due to which the back protector holds the driving trousers up and the protective part continuously in right place on the motorist's back side.

An advantage of the back protector of the invention is that it is easy and fast to put on simultaneously with the driving trousers. Putting on the driving trousers and the back protector is one single step. Because the protector is easy to put on, it is also used. Using shoulder straps for holding up the driving trousers is known to motorists, which makes it natural for them to put on and wear the back protector according to the invention. Conventional shoulder straps can simply be replaced by the back protector according to the invention. Another advantage is that the back protector according to the invention stays well in place in a normal driving situation and also in case of an accident. Thanks to its fastening, the protective part does not move under the driving jacket during driving and so it does not chafe and press the motorist. Because the back protector is not fastened to the driving jacket, the driving jacket can move freely according to the motorcyclist's movements, and the back protector does not make it difficult to wear the driving jacket in any other way either. At a fall, the protective part stays in place, because its lower part is firmly fastened to the waistband of the trousers and its upper part is supported by shoulder straps, the straps being firmly fastened to the front side waistband of the motorist's trousers. Moreover, the back protector does not press the motorist on the belly side and so it does not provide an uncomfortable feeling for him. The convenience of use is still increased by the fact that the back protector does not restrict the motorist's normal movements. It is also of benefit that the back protector gives support to the motorist's back tired with the drive. Because the back protector and the shoulder straps attached to it can be fastened to the driving trousers with buttons or other similar fastening means to be fastened afterwards, if necessary, and being easy to sew or attach in some other way to the waistband of the driving trousers, the back protector is of general model and can thus be arranged in most driving trousers irrespective of mark and design.

Figure 2:
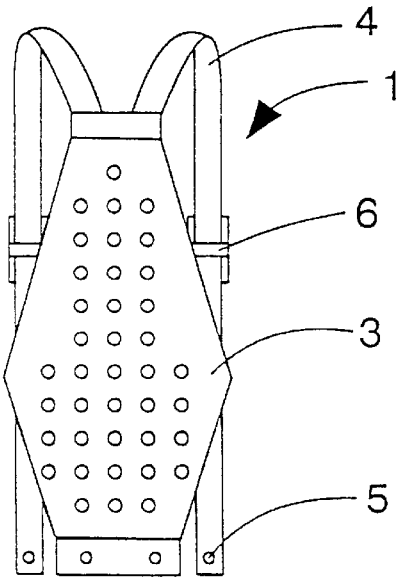

The invention will be described in greater detail in the attached drawing, in which FIG. 1 shows schematically a front view of a back protector for a motorcyclist according to the invention, fastened to driving trousers, and FIG. 2 shows schematically a rear view of the back protector for a motorcyclist according to the invention.

FIG. 1 shows schematically a front view of a back protector 1 for a motorcyclist according to the invention, fastened to driving trousers 2. The back protector 1 according to the invention comprises a protective part 3, shoulder straps 4 attached to the protective part 3 and fastening means 5 for fastening the protective part 3 and the shoulder straps 4 to the driving trousers 2. The protective part 3 is made of a light material provided with holes and absorbing impact energy, such as SBS plastic or some other corresponding material. Thanks to the holes, it has been possible to provide the protective part 3 made of a light material with an even lighter and breathing structure, which is not sweltering. The lower end of the protective part 3 comprises fastening means, which make it possible to fasten the protective part 3 to the waistband of the driving trousers 2 and to detach it from it. The fastening means 5 must be stable enough in order to resist the forces the protector is exposed to at a fall so that the protective part 3 stays in right place all the time. As fastening means 5 are preferably used buttons providing a sufficiently firm fastening. Additionally, buttons are easy to sew afterwards to driving trousers 2 of any mark and design. The first ends of the shoulder straps 4 are fastened firmly, either by sewing fixedly or by stable fastening means 5, such as some quick fasteners, to the upper part of the protective part 3. The second ends of the shoulder straps 4 are fastened firmly, e.g. by means of buttons or some other fastening means 5, to the front side waistband of the driving trousers 2. The shoulder straps 4 belonging to the back protector 1 are preferably made of a broad and elastic textile material generally used for shoulder straps. On the motorist's front side, the shoulder straps 4 comprise adjusting means 6 for a stepless adjustment of the length of the shoulder straps 4.

FIG. 2 shows schematically a rear view of the back protector 1 for a motorcyclist according to the invention. The numbering of FIG. 2 corresponds to that of the preceding figure.

The drawings and the description attached to it are only intended to illustrate the idea of the invention. As to the details, the invention may vary in the scope of the claims. So, the shape or size of the protective part has not been defined more accurately, but the protective part can be formed as desired, considering the needs and ergonomic facts. It is also possible to provide the protective part with such a structure that this structure changes its form when taking up impact forces and absorbs thus impact energy, due to which the protective part does not necessarily need to be made of a material absorbing impact energy. The back protector according to the invention can be ready-fastened to the driving trousers in connection with the manufacture of the driving trousers already or it can be fastened also afterwards by seams or riveted joints, for instance. The protective part is preferably fastened directly to the driving trousers, but it can also be fastened to the driving trousers by means of an elastic piece of fabric or the like. It is also possible to arrange the protective parts on the motorist's both sides and to join the protective parts on the motorist's belly and back side to each other and to the driving trousers by means of the shoulder straps according to the invention. In this description, shoulder straps signify all means providing the same function, due to which elastic fabric or the like can be used instead of traditional shoulder straps for holding the back protector in place and for holding up the driving trousers.

I claim:

1. A back protector for a motorcyclist, the protector comprising a protective part absorbing impact energy and shoulder straps with their first ends fastened to the upper end of the protective part, the second ends of the shoulder straps adapted to be fastened to a front side waistband of driving trousers and the lower end of the protective part adapted to be fastened to a back side waistband of the driving trousers, due to which the back protector fastened to the driving trousers serves both as a protector against falling and as a brace.

2. A back protector according to claim 1, wherein the back protector further comprises means for fastening the back protector to the driving trousers, such that the back protector can be fastened to the driving trousers and detached from them.

3. A back protector according to claim 2, wherein the means for fastening the back protector to the driving trousers comprises buttons.

4. A back protector according to claim 1, wherein the protective part is provided with holes.

5. A back protector according to claim 1, wherein the back protector comprises adjusting means for an adjustment of the length of the shoulder straps.

* * * * *